US005809390A

United States Patent [19]

Jackson

[11] Patent Number: 5,809,390

[45] Date of Patent: Sep. 15, 1998

[54] DEVICE FOR CONTROLLING PINLESS PAPER MOVEMENT IN A CONTINUOUS FORMS PRINTER

[75] Inventor: William George Jackson, Boulder, Colo.

[73] Assignee: International Business Machines Corporation, Armonk, N.Y.

[21] Appl. No.: 732,801

[22] Filed: Oct. 15, 1996

[51] Int. Cl.[6] ..... G03G 15/00

[52] U.S. Cl. ..... 399/384; 226/30; 226/42; 226/111; 399/390; 399/396

[58] Field of Search ..... 399/384, 375, 399/390, 394–397, 400; 226/95, 42, 111, 176–178, 195, 30, 31

[56] References Cited

U.S. PATENT DOCUMENTS

| | | | |
|---|---|---|---|
| 4,086,007 | 4/1978 | Smith et al. | 399/384 |
| 4,110,027 | 8/1978 | Sato et al. | 399/317 |
| 4,478,508 | 10/1984 | Kato et al. | 399/384 |
| 4,519,700 | 5/1985 | Barker et al. | 399/394 |
| 4,943,863 | 7/1990 | Ainoya | 399/297 |
| 5,170,215 | 12/1992 | Pfeuffer | 399/68 |
| 5,442,382 | 8/1995 | Pfeufer | 346/136 |
| 5,481,352 | 1/1996 | Yamamoto et al. | 399/384 |

FOREIGN PATENT DOCUMENTS

| | | |
|---|---|---|
| 57-188057 | 11/1982 | Japan . |
| 61-296373 | 12/1986 | Japan . |
| 2-201379 | 8/1990 | Japan . |
| 2-109063 | 4/1993 | Japan . |
| 5-107969 | 4/1993 | Japan . |
| 5-224547 | 9/1993 | Japan . |
| 5-224548 | 9/1993 | Japan . |

*Primary Examiner*—Matthew S. Smith
*Attorney, Agent, or Firm*—Charles E. Rohrer

[57] ABSTRACT

A continuous forms printer utilizing paper without pinholes along each edge is provided with a first paper transfer device on the input side of the printing station and a second paper transfer device on the output side of the printing station. The two paper transfer devices are operated at slightly different speeds in order to place tension in the continuous forms at the printing station in order to control registration and magnification problems. For example, a vacuum transport belt is placed on the output side and operated at a slightly greater speed than the printer. The belt is provided with friction characteristics and operated at a vacuum pressure to allow slippage of the belt and paper at the desired tension. By placing positive paper control on the output side, the directional stability of the continuous forms is improved thus avoiding skew control problems.

23 Claims, 4 Drawing Sheets

DEVICE FOR CONTROLLING PINLESS PAPER MOVEMENT IN A CONTINUOUS FORMS PRINTER

This invention relates to moving continuous forms through a printer without using tractor pins situated in pinholes along each edge of the continuous forms paper.

BACKGROUND OF THE INVENTION

High speed printers connected to mainframe computing equipment often produce output at a rate exceeding 200 pages per minute. The paper fed through such printers s continuous forms (not cut sheet) and comes in large rolls or stacks with the paper frequently 17 inches or more in width. Such paper ordinarily contains strips along each edge which contain pinholes for mating with tractor pins to move the continuous forms paper through the printer. Recently, high speed printers have been modified to operate in a tractorless (pinless) mode to move a paper without pinholes along each side through the printer. In the tractorless printer an input continuous forms transport device such as a drive roll and pressure roll nip assembly is positioned in the paper path at approximately the location of the input tractors in order to move continuous forms paper through the printing station to an output continuous forms transport device such as a roll nip assembly. Both the input and the output transport devices are controlled to move the paper through the printer at the required speed to receive non-distorted print at the printing station. In such printers the input and output transport device speed is regulated to match the speed of the printer in the same manner as input and output tractors are matched in speed to the printer. With tractors, however, there is positive mechanical assurance that the paper moves exactly at the speed that it should move since the tractor pins are placed in pinholes of the continuous forms paper. With an input drive and pressure roll assembly and pinless paper, however, there is no positive mechanical assurance. This lack of assurance is due to tolerances in the size of the rolls, wear in the rolls over time and perhaps due to some slippage between the rolls and the paper. This problem, if not corrected, can result in misregistration wherein the top of the paper page is not coincident with the top of the print for that page. In order to compensate for the problem, a stepper motor acting through a differential mechanism alters the speed of the input drive roll around the nominal in accordance with sensed paper speed.

As described above, both input and output transport devices are regulated to the speed of the printing station. Because of the need, however, to provide some additional speed compensation to the input transport device via the stepper motor mentioned above to maintain registration, the continuous forms paper is actually moved a little faster and then a little slower around a nominal speed by stepper motor activity. This can result in a magnification or reduction effect for the print received at the printing station. Additionally, the paper may bubble toward the printing station resulting in smears. Smearing is caused by a mismatch of velocity between the continuous forms and the printing station. This mismatch of velocity is most prominent when starting and stopping the continuous forms paper. An object of the present invention is to provide a mechanism to control tension of the continuous forms at the print station so that magnification/reduction and smearing problems are alleviated in pinless mode.

When a tractor fed printer is set up the tractor fed paper is positioned within the printer so that the front edge of a page in the continuous forms will be registered properly. Paper is thereafter held by the pins in that proper registration. In a tractorless mode, however, for pre-printed forms registration marks are pre-printed on the leading edge of each page of the continuous forms. A registration mark sensor is provided in order to sense the position of the beginning of a page and activate the stepper motor to cause it to reach the printing station with the beginning of page transfer. It has been found, however, that variations in tension in the continuous forms at the printing station can cause misregistration even with the stepper motor activated. In fact, stepper motor activity creates variations in tension at the printing station. It is an object of this invention to maintain registration of pre-printed forms by maintaining tension at the printing station.

Misregistration is not a problem in tractorless mode when plain paper (not pre-printed forms) are in use in simplex mode. However,if the job is in duplex mode, printing of the reverse side requires matching the top of the page already printed with the top of the page image about to be printed. To accomplish that, the printer may print a mark at the top of the page when printing the front side so that the mark can be sensed by the registration mark sensor when printing the back side to accomplish registration. The above-mentioned stepper motor is activated to maintain registration in duplex mode. The problems discussed above, relating to variation in tension at the printing station result. It is an object of the current invention to provide a device which maintains desired tension to enable and maintain proper registration of pinless forms at the printing station of a high speed printer.

Because of the distance between the printing station and the output transport device in a large high speed printer, provision is made in tractor fed devices to provide for skew correction in order that skew errors may be compensated by servo equipment. When a high speed printer is operated in tractorless mode it has been found that the directional stability of the continuous forms paper is reduced to the point where skew error can fall outside of the operating window of the servomechanism thereby resulting in machine shutdown. The present invention is directed at a solution to that problem, that is, to provide sufficient directional stability to continuous forms paper so that the skew control mechanism can operate satisfactorily.

SUMMARY OF THE INVENTION

Briefly stated, this invention solves the skew, magnification and registration problems by providing mechanisms on the input and output sides of the print station to grip the pinless continuous forms paper and give it directional stability and create a desired tension in the continuous forms paper as it passes through the printing station. Providing an appropriate mechanism is especially difficult in an electrophotographic printer where non-fused powder resides on the continuous forms for a substantial distance between the printing station and the fuser.

In a preferred embodiment, a drive and pressure roll nip assembly is placed on the input side and a vacuum transport device is provided on the output side of the printing station with a transport belt running at a speed slightly faster than the speed of the continuous forms. By regulating vacuum pressure and transport belt frictional characteristics a desired tension force is placed into the paper. Accurate paper velocity is maintained by the input roll nip assembly and tension is maintained by the vacuum transport device because the design parameters of the vacuum transport belt allow the belt to slip relative to the paper. By maintaining tension at the printing station, magnification problems are minimized as are registration problems. By providing directional stability to the continuous forms, excessive skew is minimized so that the skew control mechanism can operate within its operating window.

The vacuum transport drives the continuous forms on the non-printed side thus avoiding the smearing of unfused toner in an electrophotographic printer, with the vacuum providing sufficient force to generate the desired tension across the printing station. The coefficient of friction between the belt and the continuous forms is designed to allow the belt to slip relative to the paper once the desired tension in the paper is attained. Thus, the vacuum transport only controls the tension in the forms, not the speed of the forms through the printer. The vacuum transport is located at the output side of the printing station and is movable in a direction perpendicular to the paper path in order to center the vacuum transport on all form widths.

The above mentioned objects and other features and objects of this invention and the manner of obtaining them will become more apparent and the invention will best be understood by reference to the following description of embodiments taken in conjunction with the accompanying drawing, a description of which follows.

BRIEF DESCRIPTION OF THE DRAWING

FIG. 3 shows the invention.

DETAILED DESCRIPTION

Figure 1:
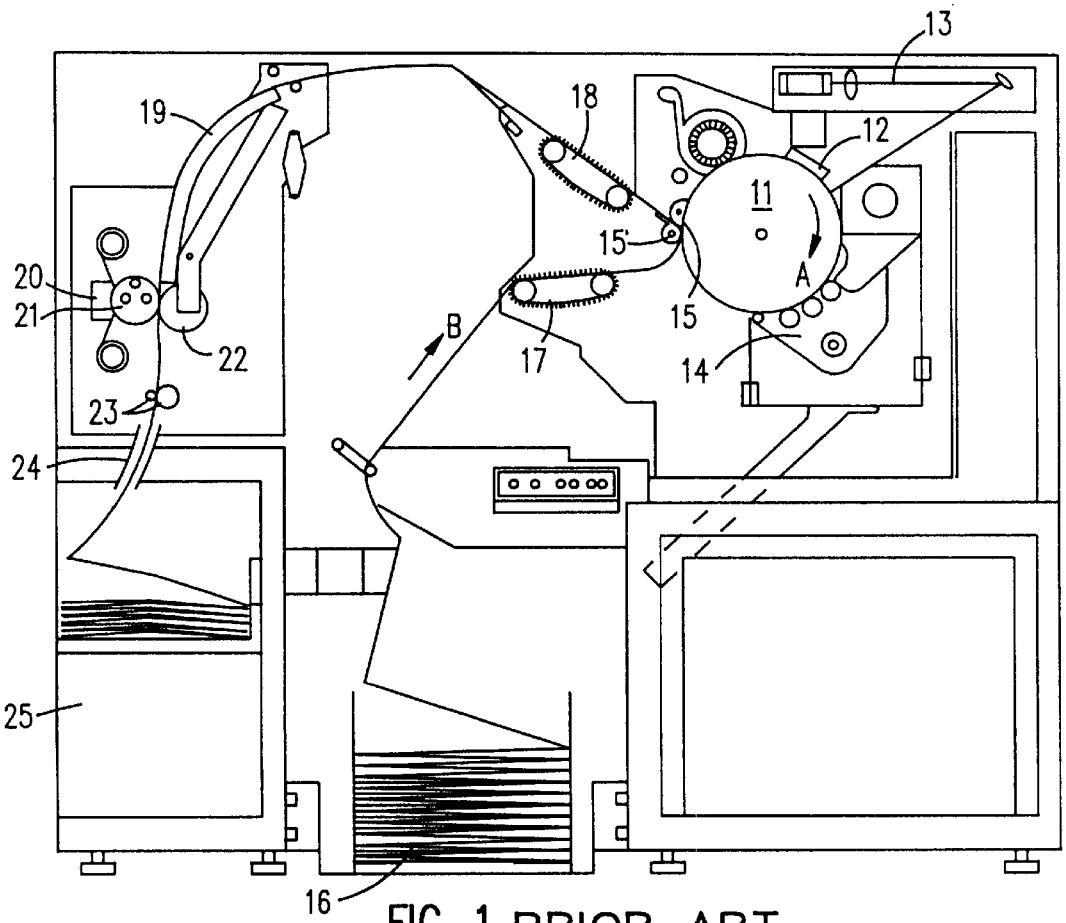
FIG. 1 PRIOR ART
FIG. 1 is a schematic diagram showing the paper path and processing stations of a prior art printing machine using tractor mechanisms to move continuous forms.

With reference to the drawing, like numbers indicate like parts and structural features in the various figures.

The invention is illustrated herein in the context of an electrophotographic printing machine wherein prints are produced by creating an image of the subject on a photoreceptive surface, developing the image and then fusing it to paper or other print receiving material. In most electrophotographic machines the process is of the transfer type where photoreceptive material is placed around a rotating drum or arranged as a belt to be driven by a system of rollers. In a typical transfer process photoreceptive material is passed under a stationary charge generating station to place a relatively uniform electrostatic charge (usually several hundred volts) across the entirety of the photoreceptive surface. Next, the photoreceptor is moved to an imaging station where it receives light rays from a light generating source which discharges the photoreceptor to relatively low levels when the light source is fully powered, while the photoreceptor continues to carry high voltage levels when the light source is turned off. Intermediate charge levels are obtained when the light source is powered at intermediate levels or for a relatively short duration. Light generating sources in an electrophotographic printer are frequently comprised of lasing means in which the laser beam is modulated by a character generator to control the power or the length of time that the laser beam exposes the photoreceptor in a particular picture element (pel or pixel) area. In that manner, the photoreceptive material is caused to bear a charge pattern which corresponds to the printing and shading desired for printing.

After producing an image on the photoreceptor, the image is moved to a developing station where developing material is placed on the image. That material is frequently in the form of a toner powder which carries a charge designed to cause the powder to deposit on selected areas of the photoreceptor.

The developed image is moved from the developer to a printing station (transfer station) where the copy receiving material (usually paper) is juxtaposed to the developed image with a small air gap between them. A charge is placed on the back side (non printed side) of the paper so that when it is positioned at the transfer station toner material is attracted across the air gap between the paper and the drum and held on the paper. In that manner, the paper receives toner depicting the developed image.

The remaining process steps are for permanently bonding the toner material to the paper and cleaning residual toner left on the photoreceptor so that it can be reused.

FIG. 1 shows a typical electrophotographic machine such as would be used to implement this invention. Photoreceptive material is placed on the surface of a drum 11 which is driven by a motor 10 (FIG. 3) to rotate in the direction A. A charge generator 12 places a uniform charge of several hundred volts across the surface of the rotating photoreceptor. The charged photoreceptor is mounted in a dark enclosure and rotates to a printhead 13 which includes a laser light generating source. The light source selectively exposes the charged photoreceptor to discharge it in areas which are desired to be developed (discharged area development, DAD process) or discharged in areas that are to remain free of toner (charged area development, CAD process). For a DAD process the charged areas of the photoreceptor provide the white background while the discharged areas are developed by developer apparatus 14 which applies toner so that the photoreceptor carries a visually perceptacle image of the data. The developed image rotates to a transfer station 15 where print paper moving in the direction B is juxtaposed with the surface of the photoreceptor. A charge opposite in polarity to the charge on the toner is placed on the non-printed side of the print paper by the transfer charge generator 15' so that when the paper is positioned at the transfer station, toner is attracted to the paper across the air gap from the surface of the photoreceptor 10.

FIG. 1 shows a tractor fed continuous forms printer where the continuous forms are stacked in an input forms area 16. The continuous forms are fed to the transfer station 15 by input or lower tractors 17 and are moved from the transfer station 15 by output or upper tractors 18. The tractor pins are positioned in pinholes at the edges of the paper so that the paper is stretched across the transfer station 15 to provide a desired tension which may be, for example, nominally 450 grams. In that manner, the desired air gap at the transfer station is maintained. The continuous forms paper continues through a pre-heat platen 19 and a fuser 20 comprised of hot roll 21 and backup roll 22. The paper continues through scuff rolls 23 and a pendulum mechanism 24 so that the continuous forms are stacked in an output stacker area 25.

The speed of the lower tractor mechanism 17 and the upper tractor mechanism 18 are controlled so that the speed of the tractor pins match the peripheral speed of the drum 11. In that manner, paper at the transfer station 15 is always moving at the same speed as the peripheral speed of the drum 11. Similarly, the peripheral speed of the hot roll 21 is also matched to the peripheral speed of drum 11 so that the paper is moved in a consistent manner throughout the machine.

Figure 2:
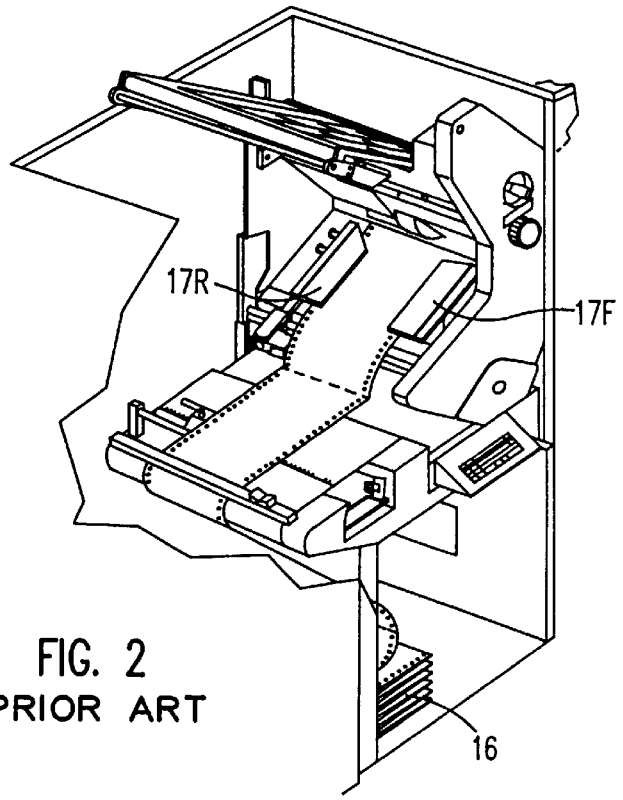
FIG. 2 PRIOR ART
FIG. 2 is a perspective view of a portion of the paper path of the machine of FIG. 1.

FIG. 2 is a cutaway perspective view showing the lower tractor 17F located on the front side of the paper path while lower tractor 17R is located on the rear side. While not shown in FIG. 2, the upper tractors are also situated on both sides of the continuous forms paper.

Figure 3:
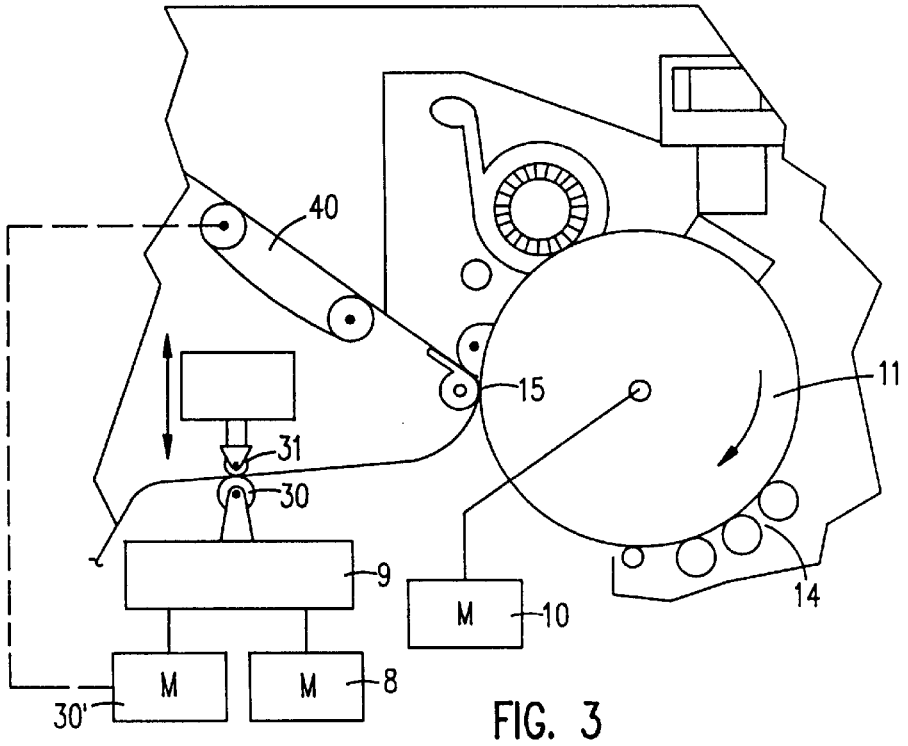
FIG. 3 is a schematic diagram showing modifications of the paper path of the machine of FIGS. 1 and 2 to enable that machine to use pinless continuous forms.
Figure 4:
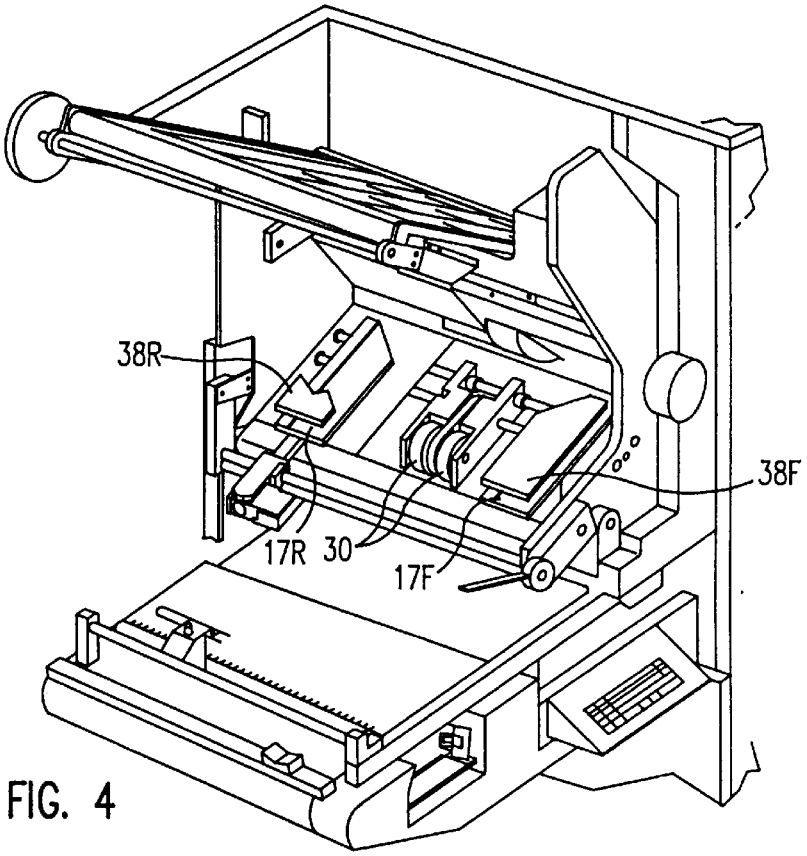
FIG. 4 is a perspective view similar to FIG. 2 showing the provision of elements in the paper path needed to enable movement of pinless continuous forms through the printer.

In a machine in which a continuous forms paper is used without the tractor holes situated on each edge, the machine of FIGS. 1 and 2 must be modified as shown in FIG. 3 to include an input paper transport device such as input drive rolls which move the paper into the transfer station. For clarity, the lower tractors 17 and upper tractors 18 have been removed from the diagram shown on FIG. 3 and the input rolls 30 and 31 added to the machine for moving the pinless continuous forms paper. Actually the input rolls 30 are located within the paper path as shown in FIG. 4 with tractors located on the sides. A printing mechanism so equipped can handle either pinhole paper or pinless paper as desired.

The drive roll 30 in FIG. 3 is driven by the tractor motor 30' which is served to the speed of the drum 11 by an encoder (not shown) placed on the drum drive motor 10. Drive roll 30 is also driven through a differential 9 by a stepper motor 8 which reacts to the speed of the paper to maintain proper registration. Thus, if there is no slippage and if all roll diameters are of exact nominal size, paper will move through the transfer station at the peripheral speed of the drum without stepper motor activity. However, if there is variation in speed of the paper through the transfer station, or if the paper moves at a speed not equal to the peripheral speed of the drum, that variation is sensed and the stepper motor is activated to make up the difference between the nominal speed and the actual speed.

The pressure roll 31 can be opened and closed in contact with drive roll 30. Pressure roll 31 is opened for threading the paper through the machine and closed for machine operation. Upper tractors 18 are not shown in FIG. 3 for clarity and a vacuum transport device 40 has been inserted. Actually the vacuum transport is positioned in the middle of the paper path and the tractors on each edge so that in the actual machine either pinless paper or tractor fed paper can be utilized. The vacuum transport device 40 is driven by tractor motor 30' to maintain a transport belt speed slightly greater than the speed of the paper as will be explained below.

FIG. 4 shows the drive rolls 30 positioned in the paper path between the lower tractor drive 17F at the front of the machine and lower tractor drive 17R at the rear of the machine. In FIG. 4 lids 38F and 38R are closed over the tractor pins as they would be in operation with paper positioned on the tractor pins. The closed lids 38F and 38R capture the paper on the tractor pins for tractor fed forms.

Figure 5:
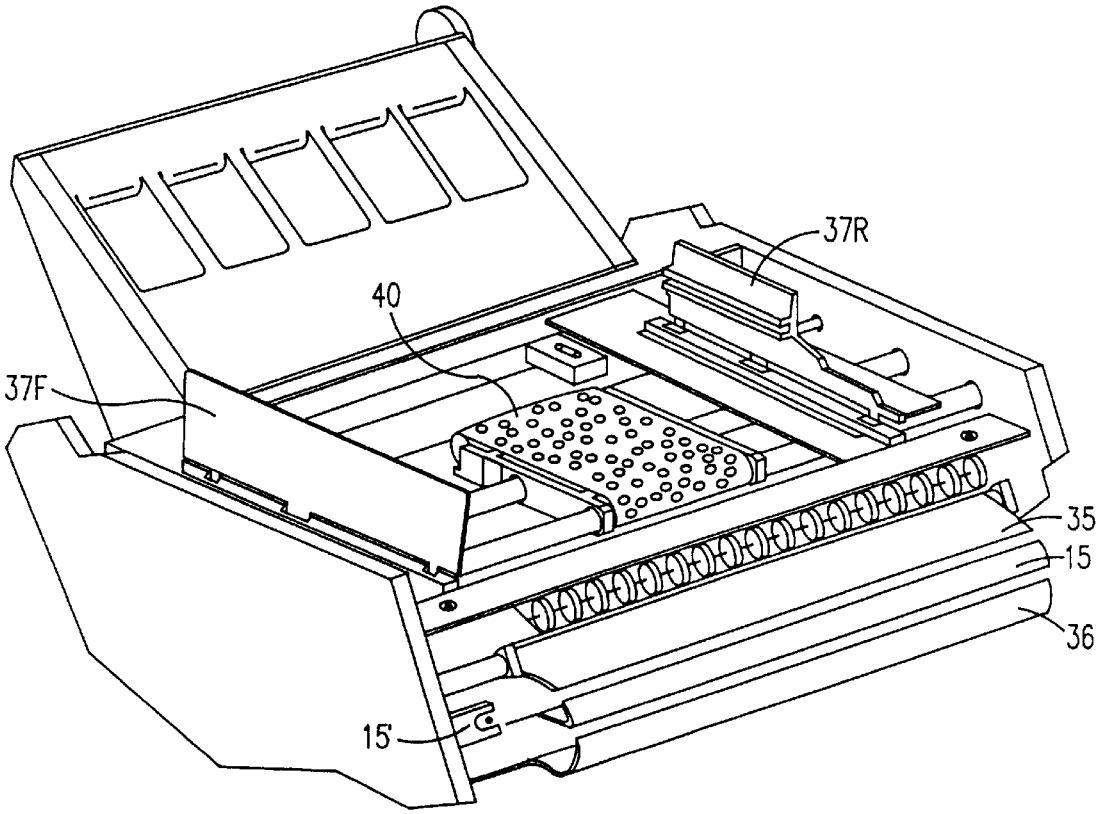
FIG. 5 is a perspective view of the paper path showing the location of a device implementing the invention.

FIG. 5 shows the vacuum transport device 40 positioned in the paper path with the upper tractor 18F located at the front of the paper path and upper tractor 18R located at the rear of the paper path. Lids 38F and 38R are shown in a raised position. FIG. 5 also provides a view of transfer corona 15' with retractors 35 and 36 on either side. The paper moves over the surface of the retractors with the transfer corona directly behind them. The air gap from the surface of the paper to the drum surface is positioned at approximately 0.4 mm by the retractors.

Figure 6:
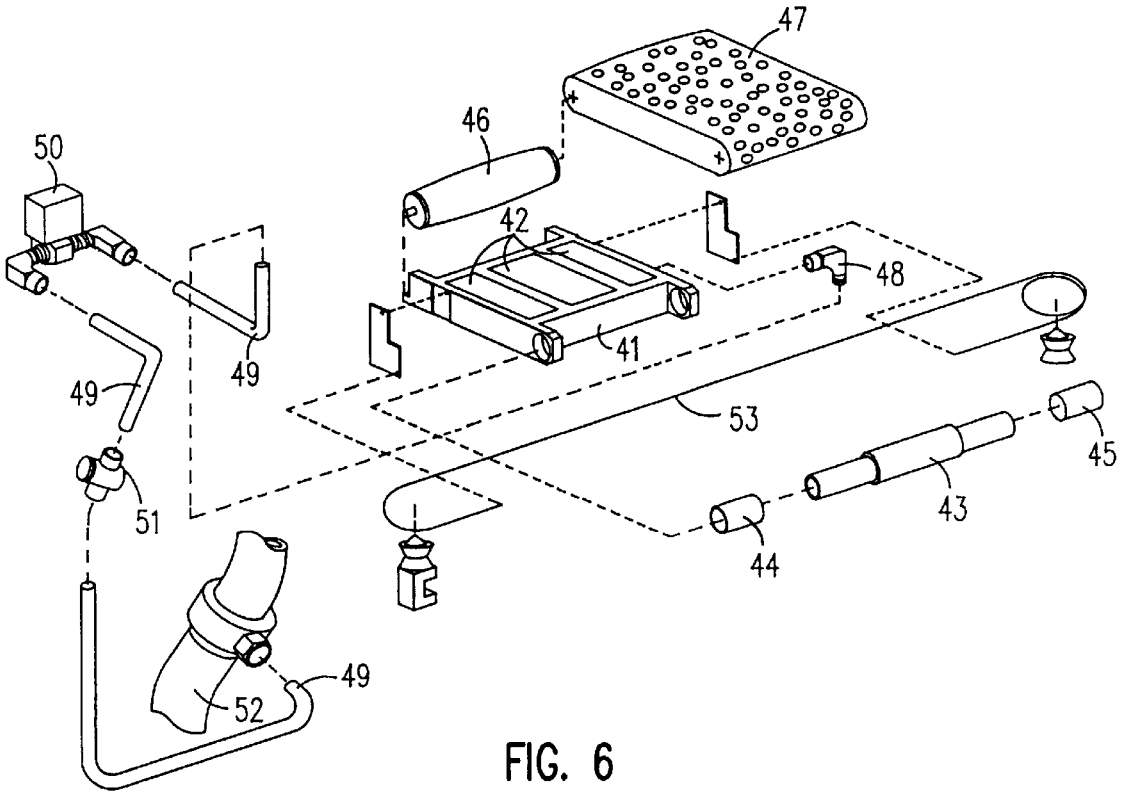
FIG. 6 is an exploded view of the device shown in FIG. 5 showing the components of a preferred embodiment of the invention.

FIG. 6 is an exploded view of the vacuum transport device 40 which is the preferred embodiment of the invention. Vacuum transport device 40 is comprised of a base mount 41 which serves as a vacuum plenum with opening 42 located in that side of the base mount situated in the paper path. A drive pulley 43 is driven by a spline shaft (not shown) and is located on one end of the base mount in bushings 44 and 45. A crown idler roll 46 is situated at the opposite end of the base mount. A perforated, nonstatic continuous transport belt 47 extends around the base mount with the bottom surface of the transport belt directly adjacent to and covering the openings 42 in the base mount. The belt has a pattern of ¼ inch diameter holes.

The transport belt 47 is wrapped around both the drive pulley 43 and idler crown roll 46 such that the belt is driven by the drive pulley 43. The drive pulley 43 is mounted on a spline shaft not shown in the figures which also acts to drive the upper tractors 18F and 18R. The motor 30' for driving both the upper and lower tractors, the drive pulley 30 and the transport belt 47 is served to the speed of the drum so that the tractors move the paper at the same velocity as the peripheral speed of the drum. In the case of the vacuum transport, however, it is desired to move the transport belt at a speed 1% to 5% greater than the peripheral speed of the drum and that is accomplished by providing the diameter of the drive pulley 43 at a size large enough to create that incremental speed difference. Vacuum is supplied to the base mount 41 through the fitting 48, tubing 49, solenoid valve 50, and vacuum adjust valve 51 from a vacuum source 52.

Cable mechanism 53 is attached to the base mount in order to move the entire vacuum transport device in a direction perpendicular to the paper path in order to center the vacuum transport device in the paper path for whatever width continuous forms is being processed.

In operation, a pinless continuous forms is threaded through the machine from the input forms area 16 to the output stacker area 25. If preprinted forms are in use, a registration mark preprinted on the paper is positioned at the optical registration mark sensor which is not shown in the figures but which is near the transfer station 15. Pressure roll 31 is lowered to mate with drive roll 30 and the vacuum transport solenoid valve 50 is shifted to apply vacuum force at the transport belt and thereby to tension the continuous forms across the transfer station. As the drum rotates and an image is placed on the drum through the operation of printhead 13, the drive roll 30 is started at an appropriate time to accelerate the paper so that the top edge of the form mates with the top edge of the image at transfer station 15. The backup roll 22 of the fuser is closed and the scuff rolls are energized so that the paper is moved through the fuser and into the output station.

As mentioned above, the vacuum transport is operated at a speed slightly greater than the speed of the paper. As a result there is a slippage between the under surface (non-printed surface) of the paper and the top surface of the vacuum belt 47. In that manner, the vacuum belt does not control the speed of the paper but does provide a tensioning force across the transfer station 15 between the vacuum belt 47 and the drive roll nip 30 and 31. In the IBM 3900 printing machine using tractors, the tension across the transfer station is a nominal 450 grams. It has been found desirable in the pinless mode of the 3900 printer for the tension to be increased to as high as 1000 grams. The amount of tension provided by the vacuum transport device 40 is regulated by the vacuum adjust valve 51.

By providing the desired tension across the transfer station 15 through the vacuum transport device 40, the various problems mentioned above are remedied. Without the tension provided by the device 40, the pinless continuous forms tends to balloon out toward the drum 11 at the transfer station due to the activity of the servomotor 8 altering the speed of the drive roll 30. In proper operation the air gap across the transfer corona is 0.4 mm. Consequently, even a small movement of the paper toward the drum can cause contact between the drum and the paper resulting in a smearing of toner on the paper surface and the smearing of the image on the drum. Provision of the vacuum transport device 40 creating tension on the continuous forms minimizes that problem. Additionally, movement of the paper toward and away from the drum also creates a magnification/reduction effect on the printing, that is, since the paper speed is changing the transfer of the image from the drum to the paper appears slightly magnified or slightly reduced depending on the direction of the paper bubble movement toward or away from the drum. That problem is also minimized by keeping tension on the paper at the transfer station through the provision of the vacuum transport device 40. The device 40 provides tension that holds the paper in contact with the retractors 35 and 36, thus alleviating smearing and magnification/reduction problems.

It is desired to move the top edge of the paper into registration with the top edge of the image such that the registration is held within 1 mm. That accuracy could not be maintained without the provision of the vacuum transport device 40. Such a provision is important especially in the situation where data is being placed on pre-printed forms. Obviously, that data must be placed on the correct line of the form and therefore maintaining registration accuracy is important. By maintaining tension at the transfer station, registration accuracy is maintained.

In the IBM 3900 printing machine, a skew sensor is located in the paper path near the input to the pre-heat platen 19. For tractor mode operation the optical skew sensing device views the pinholes in the continuous forms paper. If the pinholes move past the sensor and begin to veer towards the right or left, the sensor produces an error voltage which acts to signal a servomotor to alter the force profile between the backup roll 22 and the hot roll 21 to eliminate the skew. In pinless mode there are no pinholes in the page of the continuous forms and therefore the skew sensor is used to view the edge of the paper travelling underneath it. Light reflected from a mirror finish placed in the paper path under the skew sensor reflects light back to the skew sensor with the paper itself appearing black to the sensor. As the edge of the paper veers either to the right or the left the error signal produced in the skew sensor activates the servomotor on the backup roll to correct the skew. It was found in the IBM 3900 printer that, without the vacuum transport device 40, paper tended to excessively drift to the left or right outside of the operating window of the skew sensor. When that happened, the machine would shut down. Provision of the vacuum transport device 40 provides a positive control over the directional stability of the continuous forms as it leaves the transfer station 15 such that the tendency to excessively drift in one direction or the other is minimized. Thus the vacuum transport device 40 improves the directional stability of the paper so that the skew sensing device can do its job.

Figure 7:
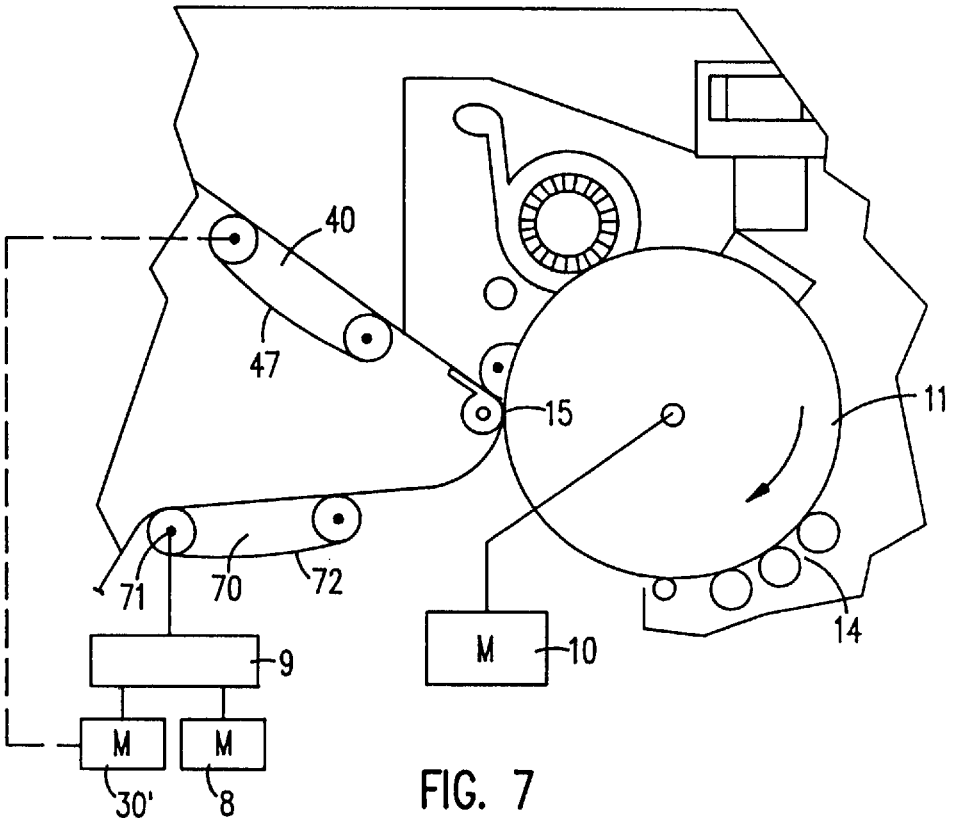
FIGS. 7 and 8 are schematic diagrams similar to FIG. 3 and show two additional configurations of the invention.
Figure 8:
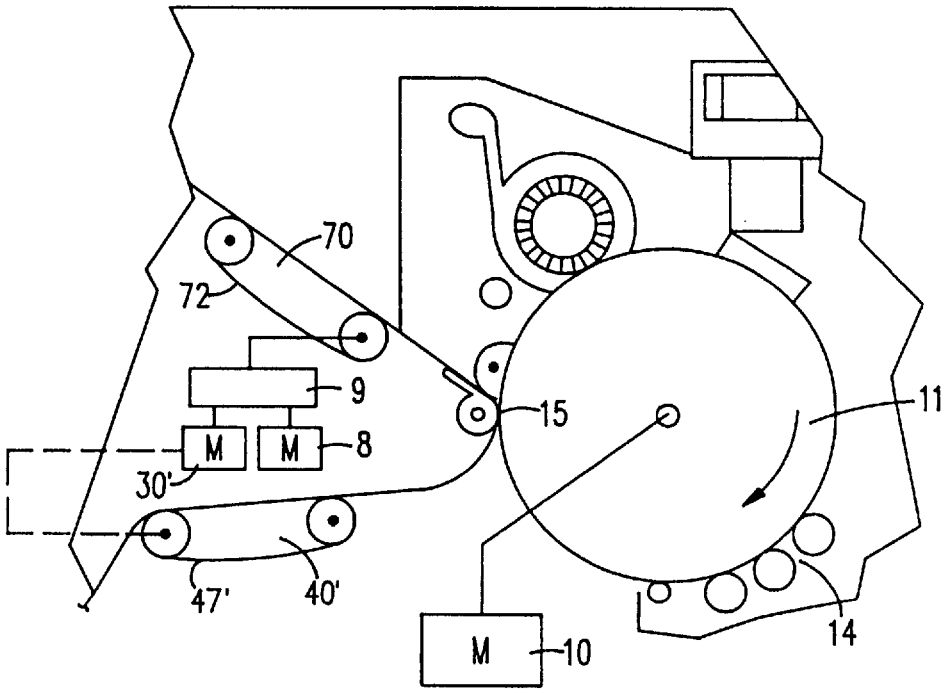

FIGS. 7 and 8 show two other preferred embodiments of the invention. In FIG. 7 the input transport drive and pressure roll nip assembly 30 and 31 shown in FIG. 3 is replaced by a vacuum transport device 70, similar in construction to the vacuum transport device 40 positioned on the output side of the printing station. The drive roll 71 of vacuum transport device 70 is powered by motor 30' which is served to the speed of the drum 11. The drive roll 71 of the vacuum transport device 70 is also driven through a differential 9 by a stepper motor 8 which reacts to the speed of the paper to maintain proper registration. In FIG. 7, the frictional characteristics of the vacuum belt 72 and the value of the applied vacuum pressure are designed to grip the continuous forms paper without allowing slippage therebetween. The vacuum transport device 40 is once again operated at a speed slightly greater than the speed of the continuous forms and is designed to accommodate slippage between the vacuum belt 47 and the continuous forms in order to maintain tension at the printing station 15 as previously described in the embodiment of FIG. 3.

In FIG. 8 the transport device 70 is placed on the output side of printing station 15 while a vacuum transport device 40' is placed on the input side. Transport device 70 operates as described above to move continuous forms through the printer at a speed synchronized to the speed of the drum 11. The vacuum transport device 40', however, operates at a speed slightly less than the speed of the continuous forms and slippage between the vacuum belt and the paper is accommodated through the design of the friction characteristics of the belt 47' and the value of applied vacuum pressure. In that manner, tension is maintained at the printing station 15.

While the invention has been described above with respect to a specific embodiment, it will be understood by those skilled in the art that various changes in form and detail may be made therein without departing from the spirit and scope of the invention. For example, the invention has been illustrated by a vacuum transport device. A system of rolls and edge guides might also be used or other equivalent apparatus on the output side of the printing station in a non-electrophotographic printer. The key is to provide a controlled constant tension at the printing station and directional stability to the pinless continuous forms. Again, such changes in form and detail may be made without departing from the spirit and scope of the invention.

What is claimed is:

1. Apparatus for moving pinless continuous forms through a printing station of a printing machine at a nominal forms moving speed required to allow said sinless continuous forms to receive non-distorted print at said printing station, said apparatus including speed compensation mechanisms to speed up or slow down actual forms moving speed around said nominal speed to maintain proper registration of the leading edge of each form of said pinless continuous forms at said printing station, comprising:

a first pinless forms transport device located on an input side of said printing station;

a second pinless forms transport device located on an output side of said printing station;

first motive apparatus connected for driving said first forms transport device at a first forms moving speed, said first motive apparatus including said speed compensation mechanisms to alter said first forms moving speed to maintain said proper registration at said printing station; and second motive apparatus connected for driving said second forms transport device, said second transport device having a forms moving surface with a forms moving speed slightly different from said first forms moving speed to create tension in said continuous forms at said printing station to minimize magnification/reduction problems and registration problems at said printing station due to speed compensation.

2. The apparatus of claim 1 wherein said nominal forms moving speed through said printing machine is less than the forms moving speed of said second transport device creating a slipping relationship between said continuous forms and the forms moving surface of said second transport device.

3. The apparatus of claim 2 wherein said second forms transport device is a vacuum transport device comprising:

a vacuum system including a vacuum source and a vacuum adjust device; and a perforated transport belt connected to said vacuum system, a first forms moving surface of said belt located in the paper path of said machine to contact a first surface of said continuous forms and hold contact through the application of vacuum to said continuous forms through said transport belt.

4. The apparatus of claim 3 wherein said transport belt has friction characteristics to accommodate said slipping relationship and wherein said vacuum adjust device allows the application of vacuum pressure to provide tension in said continuous forms in the range including approximately 450 grams nominal to approximately 1000 grams nominal.

5. The apparatus of claim 3 wherein said second forms transport device further includes:

a base mount serving as a vacuum plenum with openings on one side thereof;

a drive pulley mounted at one end of said base mount connected to said second motive apparatus;

an idler roll mounted at the opposite end of said base mount;

said perforated transport belt mounted on said drive pulley in a driven relationship thereto and mounted on said idler roll, said belt extending around said base mount in a continuous manner with a second surface of said transport belt directly adjacent to and covering said openings in said base mount for the application of vacuum pressure to said transport belt;

connecting tubing and fittings extending between said vacuum source and said base mount; and said vacuum adjust device located within said vacuum system to adjust vacuum pressure applied through said tubing to said vacuum plenum.

6. The apparatus of claim 5 wherein said printing machine is an electrophotographic printer comprising:

third motive apparatus;

photoreceptive material;

a support for said photoreceptive material, said support connected to said third motive apparatus for moving said photoreceptive material through process stations in said electrophotographic printer, said process stations including a charge station;

an imaging station;

a developing station at which toner powder is placed on an image in said photoreceptive material;

said printing station at which toner powder is transferred from said photoreceptive material to a second surface on said continuous forms;

a cleaning station for removing residual toner from said photoreceptive material;

a fusing station located in said paper path downstream from said printing station for permanently bonding said toner powder to said continuous forms; and wherein said second transport device is located in said paper path between said printing station and said fusing station, said transport belt contacting the non-printed side of said continuous forms with unfused toner residing on the printed side.

7. The apparatus of claim 6 wherein said first transport device includes a drive roll and a pressure roll nip assembly wherein said nip assembly is capable of moving said continuous forms at said first forms moving speed.

8. The apparatus of claim 7 wherein said transport belt has friction characteristics to accommodate said slipping relationship and wherein said vacuum adjust device allows the application of vacuum pressure to provide tension in said continuous forms in the range including approximately 450 grams nominal to approximately 1000 grams nominal.

9. The apparatus of claim 6 wherein said first transport device is a vacuum transport device having a perforated transport belt with a first forms moving surface located in said paper path to contact a first surface of said continuous forms and hold contact in a non-slipping relationship thereto through the application of vacuum to said continuous forms through said transport belt to move said continuous forms at said first forms moving speed.

10. The apparatus of claim 9 wherein said transport belt of said second transport device has friction characteristics to accommodate said slipping relationship and wherein said vacuum adjust device allows the application of vacuum pressure to provide tension in said continuous forms in the range including approximately 450 grams nominal to approximately 1000 grams nominal.

11. The apparatus of claim 6 wherein said transport belt has friction characteristics to accommodate said slipping relationship and wherein said vacuum adjust device allows the application of vacuum pressure to provide tension in said continuous forms in the range including approximately 450 grams nominal to approximately 1000 grams nominal.

12. The apparatus of claim 1 wherein said first pinless forms transport device is relocated to the output side of said printing station and said second pinless forms transport device is relocated to the input side of said printing station, wherein said nominal forms moving speed is greater than the forms moving speed of said second transport device creating a slipping relationship between said continuous forms and the forms moving surface of said second transport device.

13. The apparatus of claim 12 wherein said second forms transport device is a vacuum transport device comprising:

a vacuum system including a vacuum source and a vacuum adjust device; and a second transport device perforated transport belt connected to said vacuum system, a first forms moving surface of said second device belt located in the paper path of said machine to contact a first surface of said continuous forms and hold contact through the application of vacuum to said continuous forms through said second device transport belt.

14. The apparatus of claim 13 wherein said second device transport belt has friction characteristics to accommodate said slipping relationship and wherein said vacuum adjust device allows the application of vacuum pressure to provide tension in said continuous forms in the range including approximately 450 grams nominal to approximately 1000 grams nominal.

15. The apparatus of claim 13 wherein said second transport device further includes:

a base mount serving as a vacuum plenum with openings on one side thereof;

a drive pulley mounted at one end of said base mount connected to said second motive apparatus;

an idler roll mounted at the opposite end of said base mount;

said second device perforated transport belt mounted on said drive pulley in a driven relationship thereto and mounted on said idler roll, said second device belt extending around said base mount in a continuous manner with a second surface of said second device transport belt directly adjacent to and covering said openings in said base mount for the application of vacuum pressure to said second device transport belt;

connecting tubing and fittings extending between said vacuum source and said base mount; and said vacuum adjust device located within said vacuum system to adjust vacuum pressure applied through said tubing to said vacuum plenum.

16. The apparatus of claim 15 wherein said printing machine is an electrophotographic printer comprising:

third motive apparatus;

photoreceptive material;

a support for said photoreceptive material, said support connected to said third motive apparatus for moving said photoreceptive material through process stations in said electrophotographic printer, said process stations including:

a charge station;

an imaging station;

a developing station at which toner powder is placed on an image in said photoreceptive material;

said printing station at which toner powder is transferred from said photoreceptive material to a second surface on said continuous forms;

a cleaning station for removing residual toner from said photoreceptive material;

a fusing station located in said paper path downstream from said printing station for permanently bonding said toner powder to said continuous forms; and wherein said first transport device is located in said paper path between said printing station and said fusing station, said first transport device is a vacuum transport device having a first transport device vacuum transport belt contacting the non-printed side of said continuous forms with unfused toner residing on the printed side.

17. The apparatus of claim 16 wherein said first device transport belt has a first forms moving surface located in said paper path to contact said first surface of said continuous forms and hold contact in a non-slipping relationship thereto through the application of vacuum to said continuous forms through said first device transport belt to move said continuous forms at said first forms moving speed.

18. The apparatus of claim 17 wherein said second device transport belt has friction characteristics to accommodate said slipping relationship and wherein said vacuum adjust device allows the application of vacuum pressure to provide tension in said continuous forms in the range including approximately 450 grams nominal to approximately 1000 grams nominal.

19. A method of maintaining the directional stability of pinless continuous forms travelling through a printing machine at a nominal forms moving speed required to allow said pinless continuous forms to receive non-distorted print at a printing station of said printing machine, said machine including speed compensation mechanisms to speed up or slow down actual forms moving speed around said nominal speed to maintain proper registration of the leading edge of each form of said pinless continuous forms at said printing station, comprising the steps of:

providing first motive apparatus for moving said pinless continuous forms from an input station in said printing machine through a print receiving station at said nominal forms moving speed, said first motive apparatus including said speed compensation mechanisms to alter said first forms moving speed to maintain said proper registration at said printing station;

providing second motive apparatus for moving said continuous forms to an outlet station in said printing machine at said nominal forms moving speed; and providing gripping apparatus between said printing station and said second motive apparatus to bear upon and grip a first surface of said pinless continuous forms to provide directional stability between said printing station and said second motive apparatus despite forms moving speed variation resulting from said speed compensation mechanisms.

20. The method of claim 19 wherein the step of providing said gripping apparatus includes providing a vacuum transport belt with a first surface of said belt contacting and gripping said continuous forms through the application of vacuum pressure on said first surface of said continuous forms.

21. The method of maintaining tension in pinless continuous forms moving through a printing station of a printing machine at a nominal forms moving speed required to allow said pinless continuous forms to receive non-distorted print at said printing station, said machine including speed compensation mechanisms to speed up or slow down actual forms moving speed around said nominal speed to maintain proper registration of the leading edge of each form of said pinless continuous forms at said printing station, comprising the steps of:

providing a first pinless forms transport device on an input side of said printing station;

providing a second pinless forms transport device on an output side of said printing station;

providing a first motive apparatus for driving said first forms transport device at a first forms moving speed, said first motive apparatus including said speed compensation mechanisms to alter said first forms moving speed to maintain said proper registration at said printing station; and providing a second motive apparatus for driving said second forms transport device at a second forms moving speed slightly different from said first forms moving speed to create tension in said forms at said printing station to minimize magnification/reduction problems and registration problems at said printing station due to speed compensation.

22. The method of claim 21 wherein said first forms moving speed is less than said second forms moving speed.

23. The method of claim 21 wherein said first pinless forms transport device is relocated to said output side of said printing station and wherein said second pinless forms transport device is relocated to said input side of said printing station and wherein said first forms moving speed is greater than said second forms moving speed.

* * * * *

UNITED STATES PATENT AND TRADEMARK OFFICE

CERTIFICATE OF CORRECTION

PATENT NO. : 5,809,390
DATED : September 15, 1998
INVENTOR(S) : Jackson

It is certified that error appears in the above-identified patent and that said Letters Patent is hereby corrected as shown below:

On the title page: Item [56]

References cited should include:

U.S. PATENT DOCUMENTS

| | | |
|---|---|---|
| 3,999,454 | 12/76 | Tiso et al. |
| 4,671,686 | 6/87 | Howes et al. |
| 4,682,904 | 7/87 | Yoshimura et al. |
| 4,684,547 | 8/87 | DiStefano et al. |
| 4,767,689 | 8/88 | Bibl et al. |
| 4,792,249 | 12/88 | Lahr |
| 4,952,950 | 8/90 | Bibl et al. |

FOREIGN PATENT DOCUMENTS

| | | |
|---|---|---|
| 02-109063 | 4/90 | Japan |

and should not include

| | | |
|---|---|---|
| 02-109063 | 4/93 | Japan |

UNITED STATES PATENT AND TRADEMARK OFFICE

CERTIFICATE OF CORRECTION

PATENT NO. : 5,809,390

DATED : September 15, 1998

INVENTOR(S) : Jackson

It is certified that error appears in the above-identified patent and that said Letters Patent is hereby corrected as shown below:

In the Claims

Col. 8, line 49: change "sinless" to --pinless--

Signed and Sealed this

Fourth Day of January, 2000

*Attest:*

*Attesting Officer*

*Acting Commissioner of Patents and Trademarks*